US007461927B2

(12) United States Patent
Piatt et al.

(10) Patent No.: US 7,461,927 B2
(45) Date of Patent: Dec. 9, 2008

(54) DROP DEFLECTION SELECTABLE VIA JET STEERING

(75) Inventors: Michael J. Piatt, Dayton, OH (US); Michael F. Baumer, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/682,343

(22) Filed: Mar. 6, 2007

(65) Prior Publication Data

US 2008/0218562 A1 Sep. 11, 2008

(51) Int. Cl.
*B41J 2/09* (2006.01)

(52) U.S. Cl. ..... 347/77

(58) Field of Classification Search ..... 347/75, 347/76, 77, 78, 79, 82, 81, 80
See application file for complete search history.

(56) References Cited

U.S. PATENT DOCUMENTS

| | | | | |
|---|---|---|---|---|
| 4,318,481 | A | 3/1982 | Lombardo et al. | |
| 4,321,609 | A | 3/1982 | Fidler et al. | |
| 4,338,613 | A | 7/1982 | Cruz-Uribe | |
| 4,364,057 | A | 12/1982 | Ebi et al. | |
| 4,734,705 | A * | 3/1988 | Rezanka et al. | 347/75 |
| 5,001,497 | A | 3/1991 | Wills et al. | |
| 5,070,341 | A | 12/1991 | Wills et al. | |
| 5,434,609 | A | 7/1995 | Rhodes | |
| 5,491,362 | A | 2/1996 | Hamzehdoost et al. | |
| 6,012,805 | A | 1/2000 | Hawkins et al. | |
| 6,079,821 | A | 6/2000 | Chwalek et al. | |
| 6,109,739 | A | 8/2000 | Stamer et al. | |
| 6,217,163 | B1 | 4/2001 | Anagnostopoulos et al. | |
| 6,247,801 | B1 | 6/2001 | Trauernicht et al. | |
| 6,390,610 | B1 | 5/2002 | Hawkins et al. | |
| 6,505,921 | B2 | 1/2003 | Chwalek et al. | |
| 6,508,532 | B1 | 1/2003 | Hawkins et al. | |
| 6,508,542 | B2 * | 1/2003 | Sharma et al. | 347/77 |
| 6,509,917 | B1 | 1/2003 | Chwalek et al. | |
| 6,520,629 | B1 * | 2/2003 | Sharma et al. | 347/82 |
| 6,536,873 | B1 | 3/2003 | Lee et al. | |
| 2007/0257971 | A1 * | 11/2007 | Jeanmaire | 347/82 |

* cited by examiner

*Primary Examiner*—K. Feggins
(74) *Attorney, Agent, or Firm*—William R. Zimmerli

(57) ABSTRACT

A liquid ejection apparatus includes a liquid stream generator, an electrode system, and a stream deflector. The liquid stream generator includes a nozzle and is operable to produce a stream of liquid through the nozzle. The electrode system is operable to produce an electric field including a first region having a first magnitude and a second region having a second magnitude. The stream deflector is operable to selectively cause the stream to move into one of the first region and the second region.

18 Claims, 6 Drawing Sheets

DROP DEFLECTION SELECTABLE VIA JET STEERING

FIELD OF THE INVENTION

This invention relates generally to the field of digitally controlled printing devices, and in particular to continuous liquid drop ejection apparatus in which a liquid stream breaks into drops, some of which are selectively deflected.

BACKGROUND OF THE INVENTION

Defects associated with printhead nozzles, for example, nozzles formed in a nozzle plate or in a monolithic printhead structure, can produce during printhead operation fluid jets or drops of ink that are not straight. Non-straight or crooked fluid jets or drops can cause printed drop misregistration during printhead operation. These nozzle defects can be created during the printhead fabrication process. However, other sources of printed drop misregistration exist. For example, manufacturing defects associated with charging and/or deflection electrode fabrication can cause or lead to non-uniform drop charging and deflection of fluid jets or drops producing printed drop misregistration.

As such, there is a need to be able to compensate for non-straight fluid jets or drops or nonuniform drop charging and deflection during printhead operation.

SUMMARY OF THE INVENTION

According to one aspect of the invention, a liquid ejection apparatus includes a liquid stream generator, an electrode system, and a stream deflector. The liquid stream generator includes a nozzle and is operable to produce a stream of liquid through the nozzle. The electrode system is operable to produce an electric field including a first region having a first magnitude and a second region having a second magnitude. The stream deflector is operable to selectively cause the stream to move into one of the first region and the second region.

According to another aspect of the invention, a method of ejecting liquid drops includes producing a stream of liquid through a nozzle of a liquid stream generator; providing an electrode system operable to produce an electric field including a first region having a first magnitude and a second region having a second magnitude; and selectively causing the stream of liquid to move into one of the first region and the second region using a stream deflector.

Advantageously, another aspect of the invention uses small angle fluid jet steering via a stream deflector located, for example, about or at the nozzle orifice of the liquid stream generator to accomplish drop selection and/or drop trajectory control when incorporated in a continuous inkjet printing system. In this configuration, drop selection or drop separation (distinguishing between print drop and non-print (or catch) drops can be accomplished using conventional electrostatic deflection methods and devices.

For example, the invention can be used to correct for system variance in one example application. That is, non-uniform charging resulting from crooked fluid jets, non-planer charging electrodes, orifice plate bow, etc., can be sufficiently corrected by the stream deflector associated with each fluid jet such that print drop and catch drop trajectories are sufficiently uniform for the fluid jets of an array of fluid jets. In another example application, fluid jet steering can be synchronized with drop generation such that specified drops are directed closer to an electrode structure. This increases the induced charge on these drops prior to or during drop selection.

The invention permits ink to be ejected from a nozzle at a high velocity with the ejected ink being deflected using fluid jet steering. As fluid jet deflection may occur within the vicinity of the drop break-off point, small angular deflections of the fluid jet can correct for non-straight fluid jets alone or in combination with drop selection.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. When possible, like reference signs have been used to describe like features of the present invention.

Although the present invention is suitable for use in a variety of applications that use a continuous liquid drop ejection apparatus, it is particularly well suited for applications in which the liquid drop ejection apparatus ejects ink jet ink. As such, the present invention is described herein with reference to an ink jet ink printing application. However, the present invention can be used in applications in which liquids other than ink jet inks are ejected through the liquid drop ejection apparatus in the form a liquid stream that breaks into drops, some of which are selectively deflected.

Figure 1:
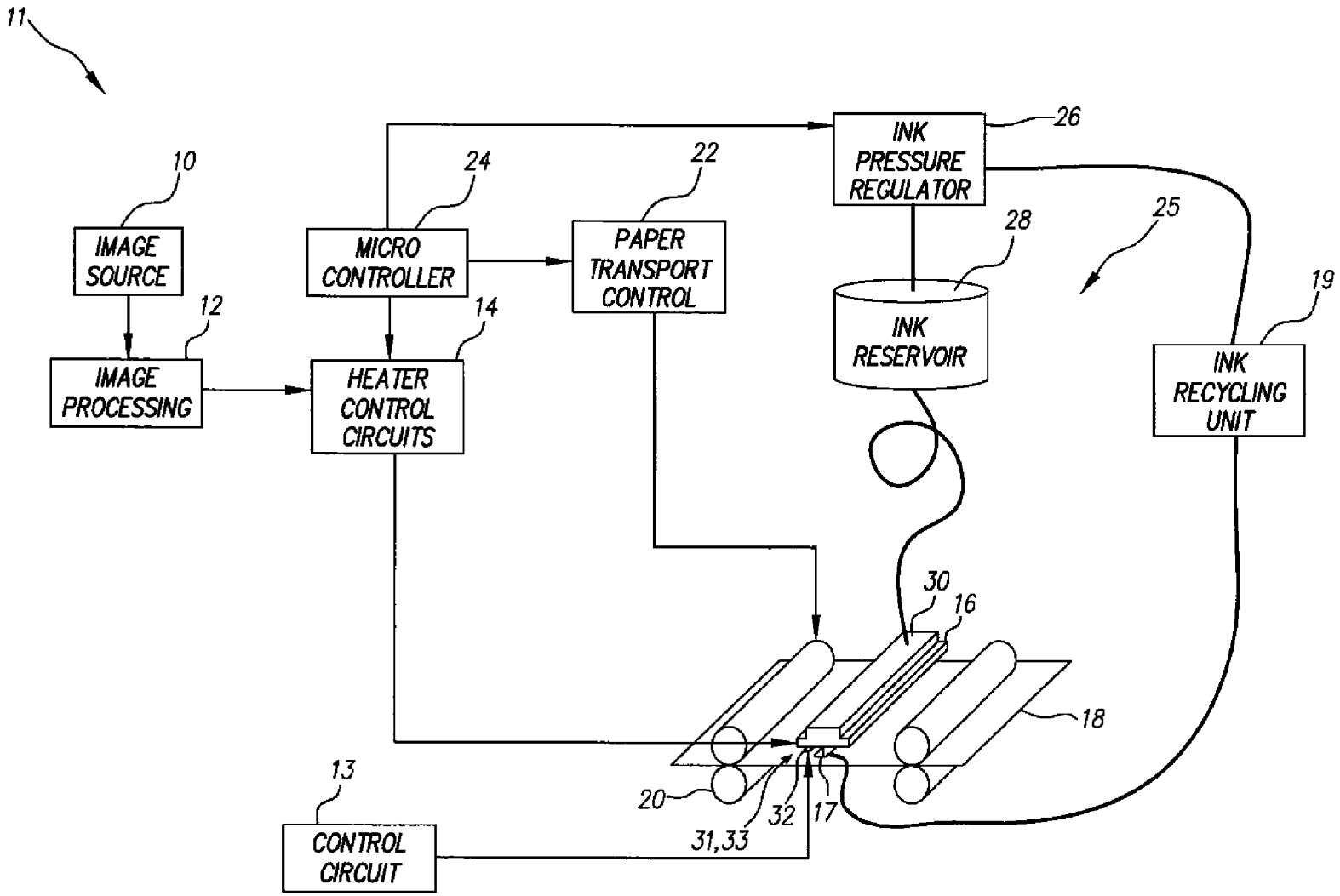
FIG. 1 shows a block schematic diagram of one exemplary printing apparatus according to the present invention.

Referring to FIG. 1, a liquid ejection apparatus 11, for example, a continuous ink jet printer system, includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a drop forming device 33, for example, heaters 32, that are part of a printhead 16. In some example embodiments, drop forming device 33 includes a stream deflector device 31. Heater control circuits 14 can be controlled by a micro-controller 24.

The time-varying electrical pulses are applied at an appropriate time, and to the appropriate nozzle, so that drops formed from a continuous ink jet stream will form spots on a recording medium 18 in the appropriate position designated by the data in the image memory. With printhead 16 fabricated from silicon, it is possible to integrate heater control circuits 14 with the printhead 16.

Recording medium 18 is moved relative to printhead 16 by a recording medium transport system 20, and which is electronically controlled by a recording medium transport control system 22, which in turn is controlled by micro-controller 24. The recording medium transport system 20 shown in FIG. 1 is a schematic only, and many different mechanical configurations are possible. For example, a transfer roller could be used as recording medium transport system 20 to facilitate transfer of the ink drops to recording medium 18. Such transfer roller technology is known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Figure 2:
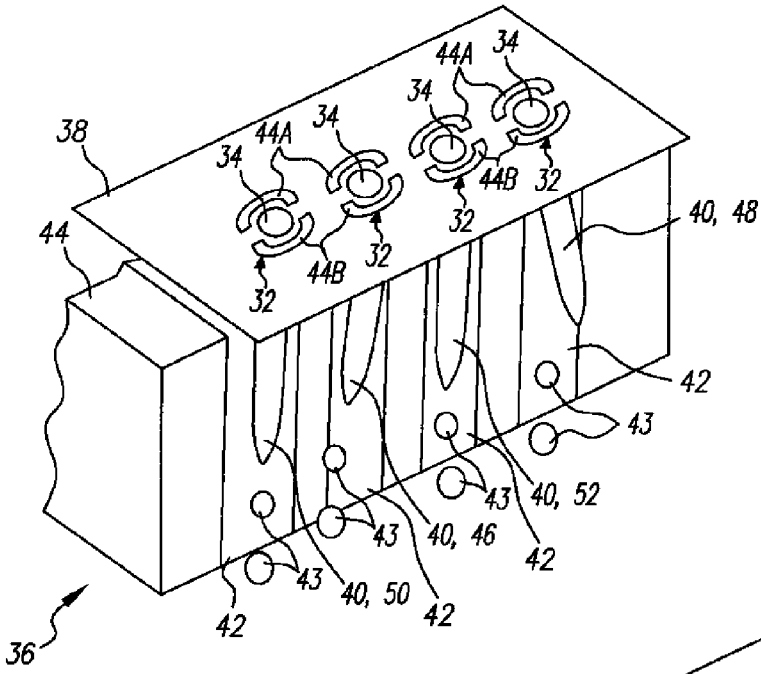
FIGS. 2 and 3 show schematic perspective views of a portion of a printhead and electrode system according to the present invention.

The liquid ejection apparatus 11 includes a liquid stream generator 25 that is operable to produce liquid streams through nozzles 34, shown in FIG. 2, located in printhead 16. For example, liquid stream generator 25 includes an ink pressure regulator 26 which can be controlled by micro-controller 24. Ink is contained in an ink reservoir 28 under pressure. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26. The ink is distributed to the back surface of printhead 16 by an ink channel device 30. The ink preferably flows through slots and/or holes etched through a silicon substrate of printhead 16 to its front surface, where a plurality of nozzles 34 and heaters 32, shown in FIG. 2, are situated.

In the non-printing state, continuous ink jet drop streams are unable to reach recording medium 18 due to an ink gutter 17 that blocks the stream and which can allow a portion of the ink to be recycled by an ink recycling unit 19. The ink recycling unit 19 reconditions the ink and feeds it back to reservoir 28. Such ink recycling units are well known in the art.

Figure 3:
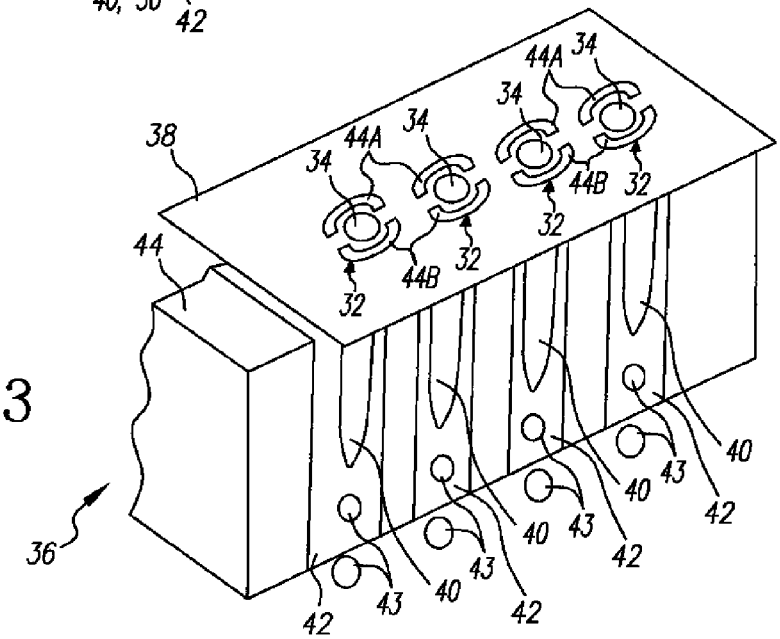

Referring to FIGS. 2 and 3, liquid ejection apparatus 11 includes an electrode system 36 positioned proximate to a nozzle plate 38 of printhead 16. Electrode system 36 is operable to produce an electric field including a first region having a first magnitude and a second region having a second magnitude, described in more detail with reference to FIGS. 5 and 6. Electrode system 36 is electrically connected to a control circuit 13, shown in FIG. 1. In one example embodiment, control circuit 13 is a DC voltage source and can be controlled by micro-controller 24.

Nozzle plate 38 of printhead 16 typically includes an array of nozzles 34 located therein, however, nozzle plate 38 can include only one nozzle 34. Stream deflector device 31, for example, heater 32, is located on nozzle plate 38 and positioned about each nozzle 34. Stream deflector device 31 is operable to selectively cause a liquid stream 40 (also referred to as a liquid jet, a liquid filament, etc.) ejected through nozzle 34 to move or deflect into one of the first region and the second region of the electric field produced by electrode system 36. Stream deflector device 31 is also operable to move or deflect the liquid stream 40 between the first region and the second region of the electrode field after liquid stream 40 is in one of the first region and the second region.

The electrode system 36 configuration shown in FIGS. 2 and 3 includes individual electrodes 42 associated with each nozzle 34. However, other configurations are permitted as described in more detail with reference to FIGS. 7, 8, and 9. Liquid stream 40 breaks into liquid drops 43 after liquid stream 40 passes a portion 44 of electrode system 36 positioned closest to nozzle plate 38.

Figure 4:
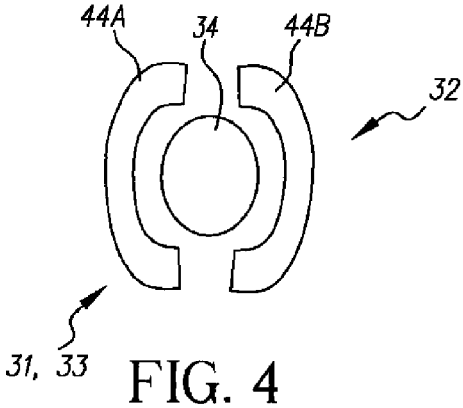
FIG. 4 shows an example embodiment of a stream deflector mechanism according to the present invention.

Referring to FIG. 4, heater 32 is an asymmetric heater 44 and includes two selectively actuatable sections or segments 44A and 44B positioned about nozzle 34. This type of heater 44 has been previously described in U.S. Pat. No. 6,079,821, issued to Chwalek et al., on Jun. 27, 2000, and is incorporated by reference herein. Heater sections 44A and 44B are positioned about nozzle 34 such that, when actuated, liquid stream 40 deflects either toward electrode system 36 or away from electrode system 36 depending on which heater section 44A or 44B is actuated in the embodiment shown in FIGS. 2 and 3.

Heaters 32 having more than two selectively actuatable sections or segments can be incorporated into other embodiments of the present invention. For example, multi-segmented heaters, like the ones described in, for example, U.S. Pat. No. 6,217,163 B1, issued to Anagnostopoulos et al., on Apr. 17, 2001, incorporated by reference herein; and U.S. Pat. No. 6,213,595, issued to Anagnostopoulos et al., on Apr. 10, 2001, incorporated by reference herein, can be incorporated into other embodiments of the present invention. Alternatively, heater 32 can include one segment, for example, segment 44A or segment 44B, positioned on one side of nozzle 34.

Referring back to FIGS. 2 and 3, liquid ejection apparatus 11 includes a drop forming device 33 that, when actuated, is operable to cause a portion of liquid stream 40 to form into a liquid drop 43. When actuation is appropriately timed, drop forming device 33 is operable to form liquid drop 43 while liquid stream 40 is in one of the first region and the second region of the electric field. Alternatively, actuation of drop forming device 33 can be timed such that the drop forming device 33 is operable to form liquid drop 43 after liquid stream 40 is out of or passes through one of the first region and the second region of the electric field.

In the embodiment shown in FIGS. 2 and 3, drop forming device 33 is heater 44. However, other types of drop forming devices can be incorporated into other embodiments of the present invention. For example, drop forming device 33 can be a piezoelectric actuator, an electrohydrodynamic device, or other drop forming devices known in the art.

In FIG. 2, some liquid streams 46 and 48, commonly referred to as fluid jets, are shown jetting at a non-perpendicular angle (an example of jetting commonly referred to as being misaligned or crooked) relative to a surface of nozzle plate 38. Liquid stream 46 is jetting toward electrode system 36 while liquid stream 48 is jetting away from electrode system 36. Other liquid streams 50 and 52, commonly referred to as fluid jets, are shown jetting at a perpendicular angle (an example of jetting commonly referred to as aligned or straight) relative to a surface of nozzle plate 38. Often, drops 43 formed from liquid streams 46 and 48 (when compared to drops 43 formed from liquid streams 50 and 52) are not properly charged and, subsequently, not properly deflected because liquid streams 46 and 48 are misaligned. Drop placement errors on recording medium 18 may result reducing overall image quality.

Stream deflector device 31, for example, heater 44 can be used to reduce misalignment of liquid streams 46 and 48. By applying a steady state heat using the appropriate section 44A or 44B of heater 44, liquid streams 46 and 48 can be sufficiently steered or slightly deflected back into alignment, as shown in FIG. 3, or substantial alignment such that electrode system 36 can adequately charge and deflect drops 43. When this is done, the angle of deflection produced by the actuation of heater section 44A or 44B on liquid streams 46 and 48 is typically not enough to distinguish between print and catch drops, but is sufficient to allow drops 43 to be charged and deflected by electrode system 36 resulting in a reduction of drop placement errors on recording medium 18. The steady state application of heat to liquid streams 46 and 48 by heater 44 is typically superimposed with other applications of heat from heater 44, for example, a drop forming application of heat to liquid stream 46 and 48 from heater 44.

Figure 5:
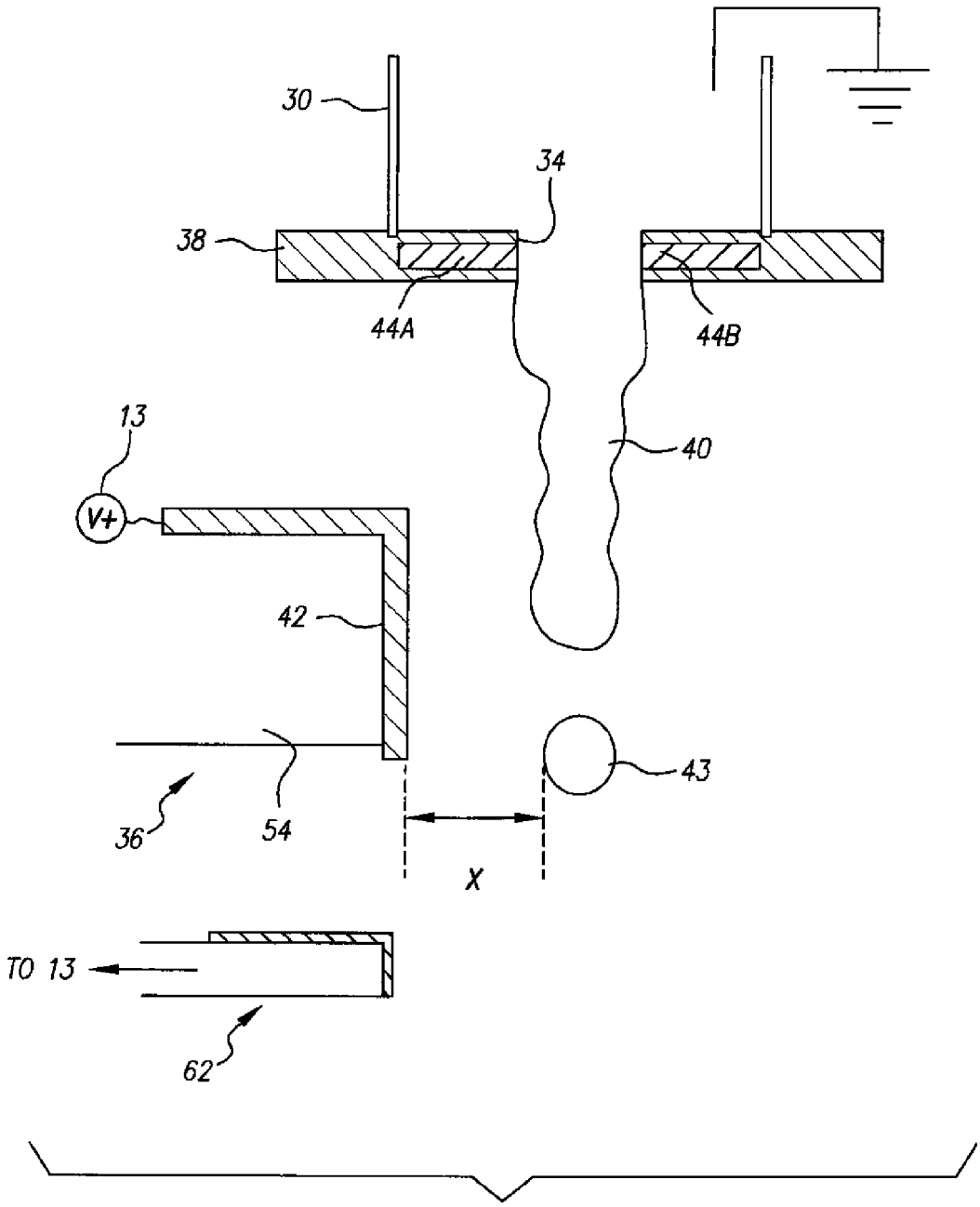
FIG. 5 shows a cross sectional schematic view of a portion of the printhead and electrode system with an unactuated stream deflector taken along line 5-5 of FIG. 3.
Figure 6:
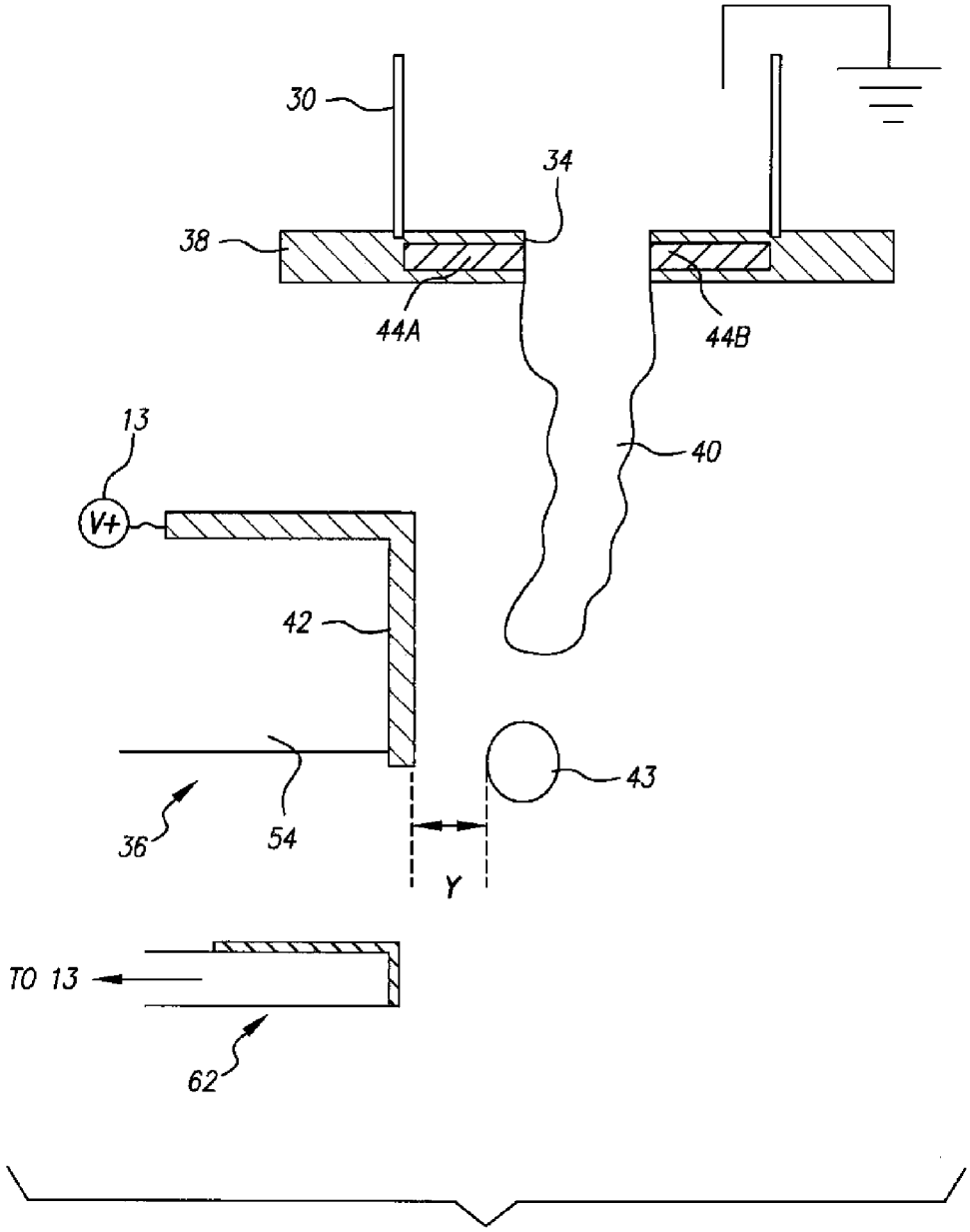
FIG. 6 shows a cross sectional schematic view of a portion of the printhead and electrode system with an actuated stream deflector taken along line 5-5 of FIG. 3.

Alternatively, a deflection electrode system 62, shown in FIGS. 5 and 6, can be positioned downstream from electrode system 36 to deflect drops 43 when electrode system 36 functions only as a charging electrode system. Deflection electrode system 62 is conventional and can be controlled by control circuit 13. Deflection electrode system 62 is positioned downstream from a drop formation location and is operable to deflect the drop in a conventional manner.

Referring to FIGS. 5 and 6, liquid stream 40 supplied from channel 30 is shown jetting through nozzle 34 located in nozzle plate 38 of printhead 16. Heater sections 44A and 44B are positioned on either side of nozzle 34. Drop 43, having been previously formed by the actuation of drop forming device 33, in this instance, one or both of heater sections 44A and 44B, is also shown. In FIG. 5, heater sections 44A and 44B are unactuated resulting in an undeflected or straight liquid stream 40. A straight liquid stream 40 also results when heat from heater 44 is applied symmetrically to liquid stream 40. In FIG. 6, heater section 44B is actuated. The asymmetric application of heat to liquid stream 40 causes liquid stream 40 to deflect toward electrode system 36.

Electrode system 36 includes an electrode 42 fabricated on a substrate 54 as is known in the art. When a DC voltage from control circuit 13 is applied to electrode 42, an electric field is produce and includes a first region having a first magnitude and a second region having a second magnitude. The electric field induces a charge on the liquid stream 40 by causing ions of the opposite sign (compared to the sign of the DC voltage being applied) to gather on the surface of the liquid stream 40. Electrode system 36 can function as a charging and deflection electrode system.

Alternatively, a deflection electrode system 62 can be positioned downstream from electrode system 36 to deflect drops 43 when electrode system 36 functions only as a charging electrode system. Deflection electrode system 62 is conventional and can be controlled by control circuit 13. Deflection electrode system 62 is positioned downstream from a drop formation location and is operable to deflect the drop in a conventional manner.

Stream deflector device 31, for example, heater 32, is operable to selectively cause a liquid stream 40 ejected through nozzle 34 to move or deflect into one of the first region and the second region of the electric field produced by electrode system 36. The stream deflector is also operable to move or deflect the liquid stream 40 between the first region and the second region after liquid stream 40 is in one of the first region and the second region. Accordingly, a technique referred to as fluid jet of liquid stream steering can be used to assist with distinguishing between print drops and catch drops formed from a continuous liquid stream or fluid jet.

It is well recognized that electrostatic field strength is a strong function of fluid jet position within the field. Electrostatic field strength varies with the square of the distance from an electrode. Hence, a fluid jet placed in an electrostatic field produces charged drops that are opposite in sign of the electrode. The amount of charge and resultant deflection of the drop can be varied by changing the position of the fluid jet filament within the electrostatic field at the time of drop break-off. Thus, the induced drop charge and resultant deflection in the presence of an electrostatic field are strongly dependent upon the distance between the drop and the charging electrode at the time that the drop breaks off from the fluid jet. It is in this manner that fluid jet steering can be used to influence the induced drop charge.

An example embodiment of this steering technique will now be discussed with reference back to FIGS. 5 and 6.

Referring to FIG. 5, drop 43 has broken off from straight fluid jet 40 and is at a specified distance X from charge electrode system 36. Distance X can be, for example, approximately 1 to 3 fluid jet diameters and is, therefore, spaced far enough away from electrode system 36 so that little to no charge is induced upon drop 43. Accordingly, the amount of resultant deflection of drop 43 is minimal (not enough to have a noticeable affect on drop trajectory) or non-existent.

Referring to FIG. 6, fluid jet 40 has been deflected toward electrode system 36 using one side of asymmetric heater 44. As a result of this deflection, drop 43 has broken off from deflected fluid jet 40 and is at a specified distance Y from electrode system 36. Distance Y can be, for example, less than 1 fluid jet diameter from electrode system 36 and is, therefore, sufficient to cause considerable induced charging in drop 43. Accordingly, the amount of resultant deflection of drop 43 is significant enough to have a noticeable affect on drop trajectory.

However, if fluid jet 40 had been deflected away from electrode system 36 (toward the right hand side of FIG. 6) using the other side of asymmetric heater 44, drop 43 would have broken off from deflected fluid jet 40 (now deflected away from electrode system 36) and would be at a specified distance greater than X from electrode system 36 and acquire a lesser charge than drop 43 as shown in FIG. 5. Accordingly, the amount of resultant deflection of drop 43 is less than that of drop 43 as shown in FIG. 5.

In the example embodiment of the steering technique shown in FIGS. 5 and 6, distance Y is less than distance X. Distance X can be considered the first region having the first magnitude of the electric field and distance Y can be considered the second region having the second magnitude of the electric field. Additionally, the amount of charge and resultant deflection of drop 43 can be varied by changing the position of fluid jet filament or liquid stream 40 within the electrostatic field (depicted in FIGS. 5 and 6 using distances X and Y) created by electrode system 36.

Figure 7:
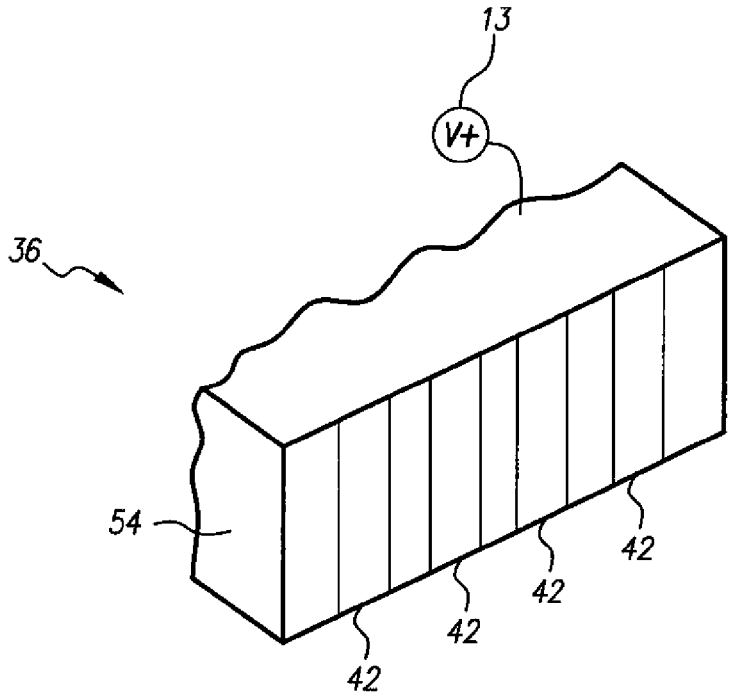
FIGS. 7, 8, and 9 show schematic perspective views of example embodiments of the electrode system according to the present invention.
Figure 8:
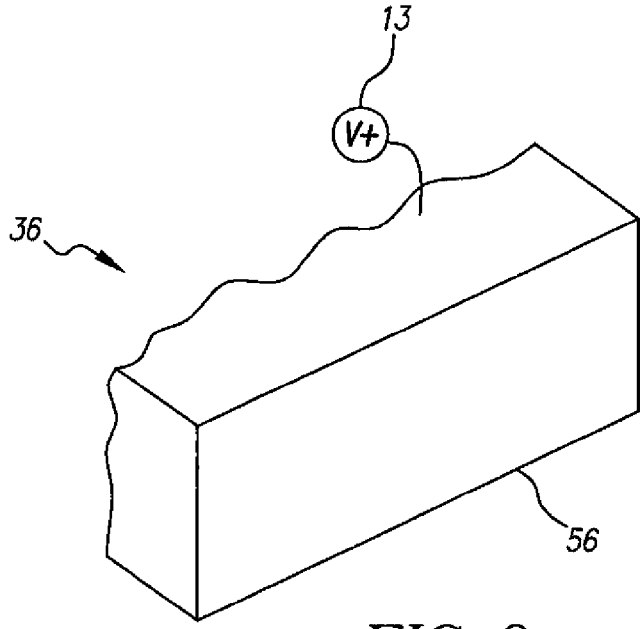
Figure 9:
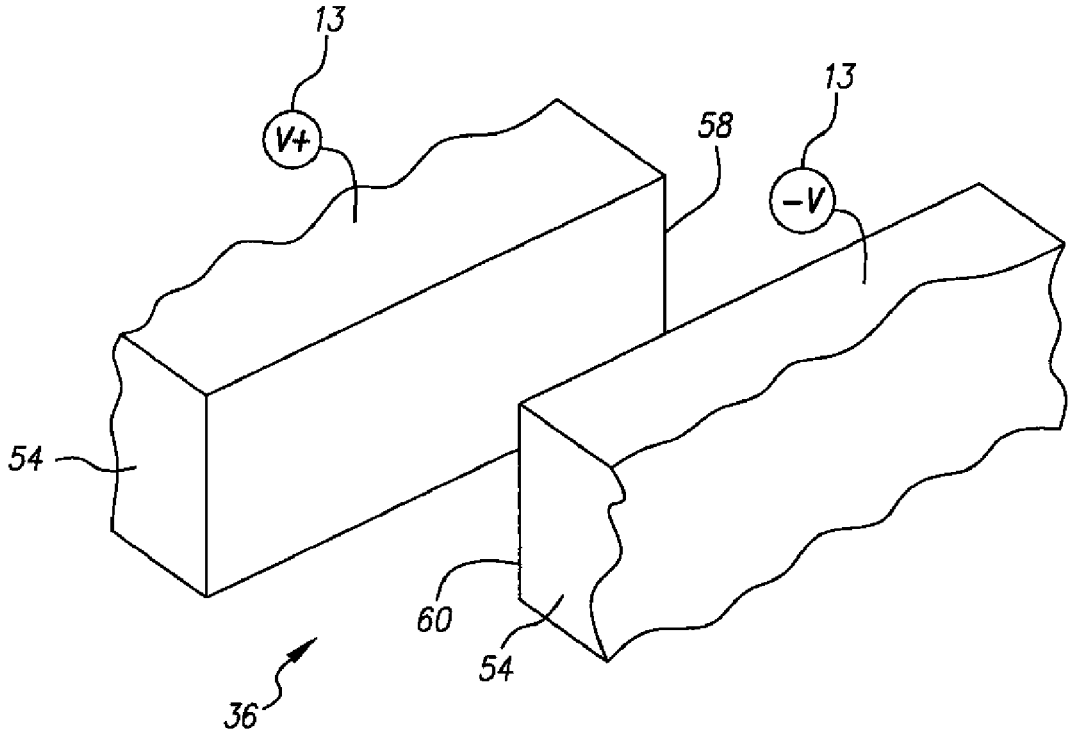

Referring to FIGS. 7, 8, and 9, example embodiments of electrode system 36 are shown. Electrode 42 structures shown in FIGS. 7, 8, and 9 can be used to help accomplish fluid jet steering in an electrostatic field for the purpose of fluid jet straightness correction and/or print drop selection.

Referring to FIGS. 7 and 8, example embodiments of electrode system 36 are shown. In these embodiments, it is not necessary to alter the voltage applied to electrode system 36 during drop formation or break off when thermal steering is used to select between print drops and catch drops.

Referring to FIG. 7, electrode system 36 includes individual electrodes 42 associated with each fluid jet, like the electrode system shown with reference to FIGS. 2 and 3. This type of electrode 42 structure or configuration is compatible with fluid jet steering for either fluid jet straightness correction as discussed with reference to FIGS. 2 and 3 and/or print drop catch drop selection discussed with reference to FIGS. 5 and 6.

Referring to FIG. 8, electrode system 36 includes a single electrode 56 associated with the entire array of fluid jets. The fluid jets can be steered either toward or away from the electric field created by electrode 56 when a charge is applied to electrode system 36. While individual fluid jet control is reduced, the electrode system 36 shown in FIG. 8 is advantaged in that fabrication is simplified. This type of electrode 56 structure or configuration is compatible with fluid jet steering for either fluid jet straightness correction as discussed with reference to FIGS. 2 and 3 and/or print drop catch drop selection discussed with reference to FIGS. 5 and 6.

Referring to FIG. 9, electrode system 36 includes two opposing electrodes 58, 60. Opposite charges are applied to electrodes 58, 60 which creates a very large field gradient (referred to as a step gradient) in the region between electrodes 58, 60. Electrode system 36 as shown in FIG. 9 is especially advantageous for thermal fluid jet steering because the step gradient amplifies small angular displacements created by fluid jet steering by dramatically changing the induced charge on the drop. The geometry of electrode system 36 as shown in FIG. 9 may even cause the induced charge on the drop to acquire either a positive or negative charge depending upon its position in the field relative to the positive and negative electrodes.

It is to be appreciated that once a drop is charged that its trajectory is determined by the electric field in its path. Hence, either charged or uncharged drops can be use for printing. Drop deflection can be toward a catcher device or toward a printed substrate, depending upon the magnitude of charge of the drop and the electrostatic field in the path of the drop at the time of its formation.

The invention has been described in detail with particular reference to certain preferred embodiments thereof, but it will be understood that variations and modifications can be effected within the scope of the invention.

PARTS LIST

10 image source
11 liquid ejection apparatus
13 control circuit
14 heater control circuit
16 printhead
17 ink gutter
18 recording medium
20 recording medium transport system
22 recording medium transport control system
24 micro-controller
25 liquid stream generator
26 ink pressure regulator
28 ink reservoir
30 ink channel
31 stream deflector device
32 heater
33 drop forming device
34 nozzle
36 electrode system
38 nozzle plate
40 liquid stream
42 electrode
43 liquid drop
44 asymmetric heater
44A heater section
44B heater section
46 liquid stream
48 liquid stream
50 liquid stream
52 liquid stream
54 substrate
56 electrode
58 electrode
60 electrode
62 deflection electrode system

The invention claimed is:

1. A liquid ejection apparatus comprising:

a liquid stream generator including a nozzle and being operable to produce a stream of liquid through the nozzle;

an electrode system operable to produce an electric field including a first region having a first magnitude and a second region having a second magnitude; and a stream deflector which does not operate as the electrode system, but instead is separate and distinct from the electrode system, operable to selectively cause the stream to move into one of the first region and the second region by causing the stream to deflect either toward or away from the electrode system.

2. The apparatus of claim 1, wherein the stream deflector is operable to move the stream between the first region and the second region after the stream deflector has caused the stream to move into one of the first region and the second region.

3. The apparatus of claim 1, further comprising:

a drop forming device operable to cause a portion of the stream to form into a drop.

4. The apparatus of claim 3, wherein the drop forming device is operable to form the drop while the stream is in one of the first region and the second region of the electric field.

5. The apparatus of claim 3, wherein the drop forming device is operable to form the drop after the stream is out of one of the first region and the second region of the electric field.

6. The apparatus of claim 3, wherein the stream deflector comprises an asymmetric heater that selectively causes the stream of liquid to move into one of the first region and the second region by asymmetrically applying heat to the stream of liquid.

7. The apparatus of claim 6, wherein the drop forming device comprises the asymmetric heater of the stream deflector.

8. The apparatus of claim 6, wherein the drop forming device comprises a piezoelectric actuator.

9. The apparatus of claim 6, wherein the drop forming device comprises an electrohydrodynamic device.

10. The apparatus of claim 1, wherein the stream deflector includes a heater with selectively actuatable heater sections that when selectively actuated deflect the stream either toward or away from the electrode system depending on which heater section is actuated.

11. The apparatus of claim 1, wherein the stream detector includes a drop forming device that includes the stream detector, and the drop forming device having a heater operable to cause a portion of the stream to form into a drop and operable to selectively cause the stream to move into one of the first region and the second region.

12. A method of ejecting liquid drops comprising:

producing a stream of liquid through a nozzle of a liquid stream generator;

providing an electrode system operable to produce an electric field including a first region having a first magnitude and a second region having a second magnitude; and providing a stream deflector which does not operate as the electrode system, but instead is separate and distinct from the electrode system, operable to selectively cause the stream of liquid to move into one of the first region and the second region using a stream deflector by causing the stream to deflect either toward or away from the electrode system.

13. The method of claim 12, wherein selectively causing the stream of liquid to move into one of the first region and the second region includes causing the stream of liquid to move between the first region and the second region after the stream is in one of the first region and the second region.

14. The method of claim 12, wherein selectively causing the stream of liquid to move into one of the first region and the second region by asymmetrically applying heat to the stream of liquid.

15. The method of claim 12, further comprising forming a drop from the stream of liquid using a drop forming device.

16. The method of claim 15, wherein forming the drop occurs while the stream is in one of the first region and the second region of the electric field.

17. The method of claim 15, wherein forming the drop occurs after the stream passes through one of the first region and the second region of the electric field.

18. The method of claim 15, wherein forming the drop from the stream of liquid includes applying heat to the stream of liquid.

* * * * *